US008451187B2

(12) United States Patent
Zihlman

(10) Patent No.: US 8,451,187 B2
(45) Date of Patent: May 28, 2013

(54) REMOVABLE FINE TUNE ELEVATION ADJUSTMENT TOOL FOR A SATELLITE ANTENNA SYSTEM

(75) Inventor: Brian Steven Zihlman, Mt. Pleasant, IA (US)

(73) Assignee: Winegard Company, Burlington, IA (US)

( * ) Notice: Subject to any disclaimer, the term of this patent is extended or adjusted under 35 U.S.C. 154(b) by 701 days.

(21) Appl. No.: 12/557,260

(22) Filed: Sep. 10, 2009

(65) Prior Publication Data

US 2010/0073256 A1 Mar. 25, 2010

Related U.S. Application Data

(60) Provisional application No. 61/099,037, filed on Sep. 22, 2008.

(51) Int. Cl.
*H01Q 3/02* (2006.01)
*H01Q 1/12* (2006.01)

(52) U.S. Cl.
USPC ..... 343/882; 343/892

(58) Field of Classification Search
USPC ..... 343/878, 880, 882, 890, 892
See application file for complete search history.

(56) References Cited

U.S. PATENT DOCUMENTS

| | | | | |
|---|---|---|---|---|
| 6,956,526 | B1 | 10/2005 | Lundstedt, Jr. et al. | |
| 7,142,168 | B1 | 11/2006 | Sinclair | |
| 2006/0181477 | A1 * | 8/2006 | Lin et al. | 343/880 |
| 2006/0231693 | A1 * | 10/2006 | Lin et al. | 248/121 |

OTHER PUBLICATIONS

HN System—Installation Manual for .74 m Ku-band Upgradeable Antenna Model AN6-074P, Oct. 19, 2006, pp. 44-52, Revision B, Hughes Network Systems, LLC, Germantown, Maryland.

* cited by examiner

*Primary Examiner* — Robert Karacsony
(74) *Attorney, Agent, or Firm* — Dorr, Carson & Birney PC

(57) ABSTRACT

A removable tool for adjusting the elevation of a satellite antenna having a shaft, a knob engaging the threads of the shaft at one end, a pivot member slideably disposed over the shaft threads; an upper pin for selectively engaging a hole at the other end of the shaft and with upper holes on the antenna mount; and lower pin for selectively engaging a pivot hole in the pivot member and lower holes on the mount. When the knob is turned the shaft adjusts the elevation in the mount by pivoting between the two bracket pairs.

20 Claims, 11 Drawing Sheets

REMOVABLE FINE TUNE ELEVATION ADJUSTMENT TOOL FOR A SATELLITE ANTENNA SYSTEM

PRIORITY CLAIM

This application claims priority to U.S. Provisional Patent Application Ser. No. 61/099,037 filed Sep. 22, 2008 which is hereby incorporated by reference in its entirety.

BACKGROUND OF THE INVENTION

1. Field of the Invention

The present invention relates to the tuning of elevation of a satellite dish antenna system during installation and, in particular, to a removable tool for fine elevation tuning of satellite dish antennas.

2. Discussion of the Background

Residential and commercial satellite antenna conventional systems are common and are available from one supplier or customer to another with differences pertaining to size, cost, design, performance and application. Many such conventional systems have mechanisms for providing fine tune elevation adjustments on satellite antenna mounts by installers. Generally these mechanisms are permanently attached to each satellite antenna mount resulting in a fixed overhead cost of manufacture. Millions of satellite antennas are in use primarily for residential reception having these permanently mounted mechanisms. A continuing need exists to reduce the manufacturing costs of such satellite antennas.

Fine elevation tuning is necessary to target the satellite antenna on the desired satellite(s) especially with larger antenna sizes and when a multi-satellite feedhorn is used. Conventional adjustment of the fine tune mechanism is typically performed by using hand tools such as a wrench or socket and ratchet drive. In addition to reducing manufacturing costs, the time it takes for installers to install and align a satellite antenna to target satellite(s) is critical. Most satellite systems have elevator shafts permanently mounted so that the installer can align the installed antenna by using hand tools. A continuing need also exists in the field for installers to perform the installation and alignment as quickly as possible.

Removal of the fine tune elevation mechanism as a permanent fixture results in manufacturing cost savings. On prior mounts, removal of the permanent fine tune elevation adjustment mechanism involved loosening bolts or nuts with hand tools, removing the bolts and nuts, and removing the fine tune adjustment mechanism. In some designs, the fine tune adjustment mechanism is permanently attached to the mount, and is not easily removed or serviceable. Replacement of the satellite antenna mount would be required in these designs. A need exists to reduce the cost of each individual satellite antenna mount by manufacturing such mounts without fine tune elevation adjustment mechanisms.

U.S. Pat. No. 6,956,526 sets forth an apparatus which allows an installer to fine tune the elevation of a satellite antenna and then to remove the elevation adjustment mechanism from the mount for use on other satellite antenna systems. Hughes Network Systems also provides an elevation pointing tool (P/N 1029130-0403) that is removable from the antenna mount. See "HN System-Installation Guide for 0.74 m Ku-band Upgradeable Antenna Model ANG-074P," Oct. 19, 2006, pgs. 44-52. Both of these approaches lower the manufacturing costs of the antenna mount by removing fine tune elevator shafts as permanent hardware on the mount, but both also require tools and installer time to utilize. A need exists for a simple tool that quickly mounts and releases for fine elevation tuning without the use of any tools either for attaching the tool to the installed antenna and/or to perform the adjustment.

Finally, a need exists for a tool designed for not only a residential satellite antenna used for the home satellite reception market, but also adopted for antenna mounts used in commercial applications as well.

SUMMARY OF THE INVENTION

A removable fine tune elevation tool for use on a satellite antenna mount having a pair of upper elevation brackets pivotally connected to a pair of lower elevation brackets. The tool includes a threaded shaft having a formed hole at one end; a knob with a formed threaded hole engaging the threaded shaft; a pivot member having a first portion with a formed hole disposed over threads of said threaded shaft and a second portion with a formed pivot hole; an upper pin for engaging the formed hole at one end of the threaded shaft and formed holes in the upper pair of elevation brackets to hold one end of the threaded adjustment shaft in the pair of upper elevation brackets; and a lower pin for engaging the formed pivot hole of the second portion of the pivot member and the formed holes in the lower pair of elevation brackets to hold the second portion in the pair of lower elevation brackets. When the knob is turned the threaded shaft moves through the formed threaded hole of the knob and abuts against the pivot member to slide the formed hole in the first portion of the pivot member over the threaded adjustment shaft to pivot the upper pair of brackets with respect to the lower pair of mounting brackets thereby adjusting the elevation of the reflector in the satellite antenna.

The summary set forth above does not limit the teachings of the invention especially as to variations and other embodiments of the invention as more fully set out in the following description taken in connection with the accompanying drawings.

DETAILED DESCRIPTION OF THE INVENTION

Figure 1:
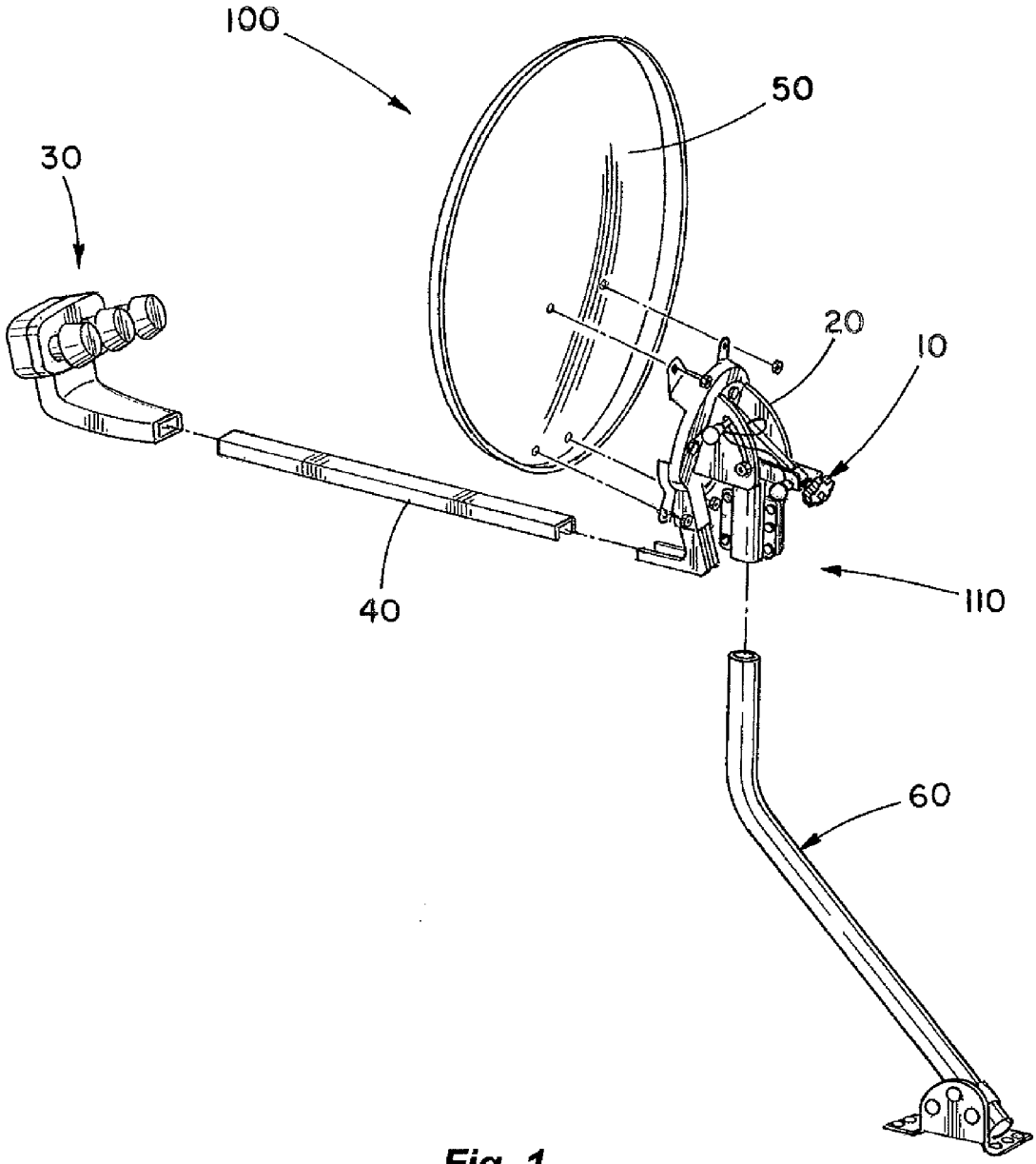
FIG. 1 illustrates, in an exploded perspective view, the components of a conventional satellite antenna and mount having the removable elevation adjustment tool of the invention.

FIG. 1 illustrates the components of a conventional satellite antenna 100 having the removable fine tune elevation adjustment tool 10 of the invention installed and ready for use. Satellite antenna 100 is positioned, in elevation, accurately with the use of the removable fine tune adjustment tool 10.

The satellite antenna 100 conventionally has a feedhorn 30 such as a multi-satellite feedhorn. A feed arm 40 holds the feedhorn 30 to an azimuth/elevation polar mount 20. The mount 20 in turn is connected to a satellite antenna reflector 50. A roof/wall support 60 is used to mount the assembled feedhorn 30, feed arm 40, mount 20 and reflector 50 to a roof, wall, post, or any convenient support (not shown). The satellite antenna 100 is an example of one conventional approach. The tool 10 of the present invention can be used with satellite antenna designs other than that shown in FIG. 1.

Figure 2:
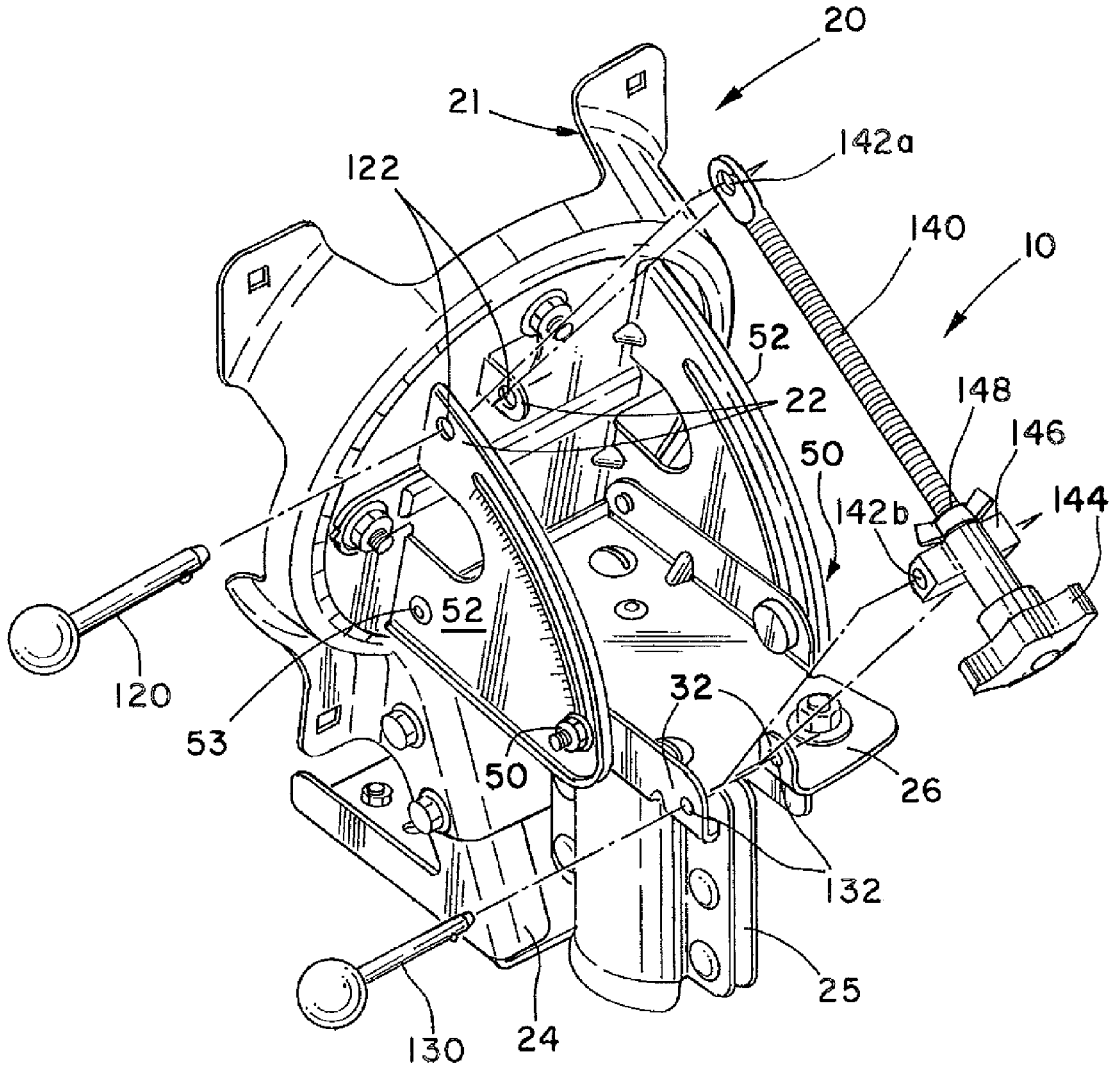
FIG. 2 is an exploded perspective view showing the elevation adjustment tool having two pins and an elevator shaft removed from the mount.
Figure 3:
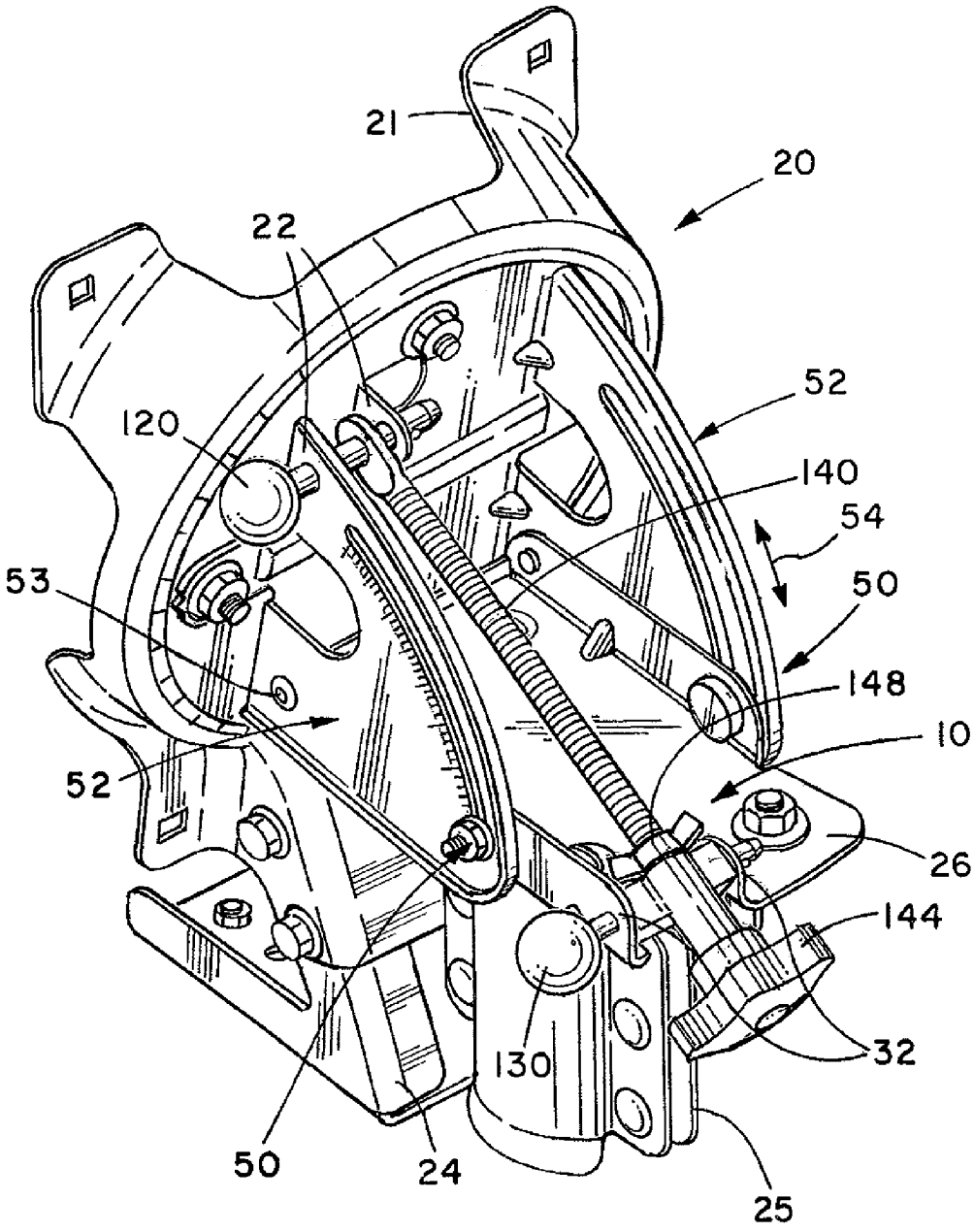
FIG. 3 is a perspective view of the elevation adjustment tool installed in the mount with the two pins installed to upper and lower holes.

As shown in FIGS. 2 and 3, the mount 20 has the following components: a reflector mounting bracket 21, an elevation upper pair of brackets 22 located on the elevation bracket 52, a feed tube attachment bracket 24, an azimuth clamping bracket 25, an azimuth base bracket 26, and a lower pair of elevation brackets 32 located on the azimuth base bracket 26. Mounts for satellite antennas vary in design but all have functional components for mounting a reflector 50, a feed arm 40, and support 60 as well as components for adjusting for elevation. The conventional permanent fine tune adjustment mechanism (not shown) would be connected between brackets 22 and 32 but is not used here so as to reduce manufacturing cost of the mount 20. Mounts 20 can also be specifically made to have brackets 22 and 32 so as to be designed to be used with the tool 10 of the invention.

When nuts 50 are loosened on the elevation guides 52, the reflector mounting bracket 21 and elevation bracket 52, conventionally pivots at point 53 with respect to the azimuth base bracket 26 as shown by arrow 54 (FIG. 3). The tool 10 when installed is used to perform this pivoting until the proper fine tune elevation adjustment is made and then the nuts 50 are tightened. How to arrive at proper fine elevation tuning is well understood by installers.

As shown in FIG. 2, two removable pins 120 and 130 are installed by pressing them through an upper set of holes 122 of brackets 22 and a lower set of holes 132 of brackets 32 in the mount 20 and holes 142*a* and 142*b*, respectively, of the tool 10. As shown in FIG. 3, the two pins 120 and 130 install the tool 10 to mount 20 between holes 122 and between holes 132. An adjustment knob 144 is also utilized to accurately adjust the elevation of the antenna in the directions of arrow 54. The installation and removal of the tool 10 can be performed without the use of any hand tools.

After fine tuning of elevation occurs, the nuts 50 are tightened and the tool 10 shown in FIGS. 2 and 3 is then removed by pulling out pins 120 and 130. The tool 10 can be utilized by installers over many different installations by removing the tool 10 and re-installing it on other satellite antenna mounts.

Figure 4:
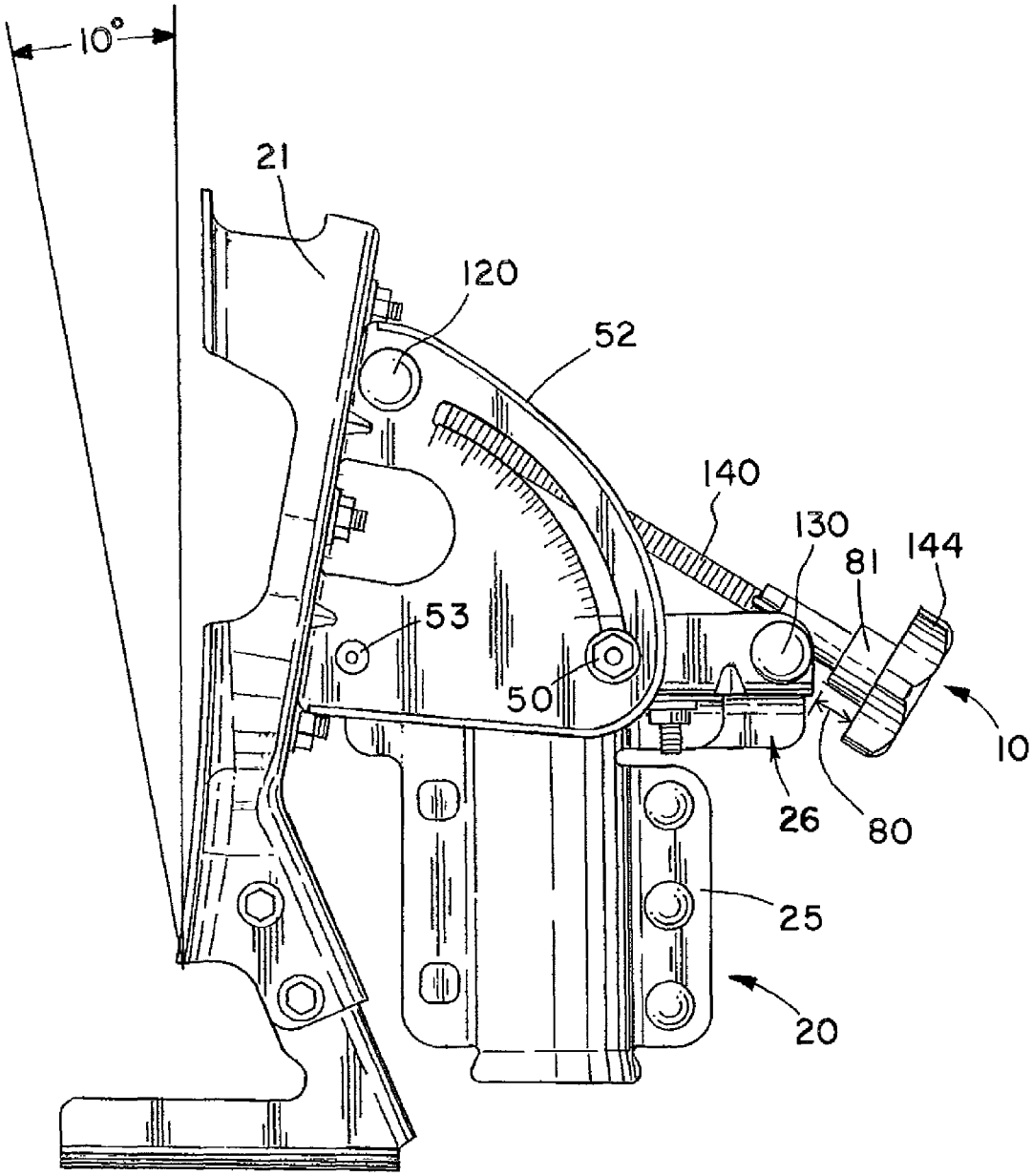
FIG. 4 is a side planar view of FIG. 3 with the elevator shaft holding the reflector mounting bracket in a 10 degree position.
Figure 5:
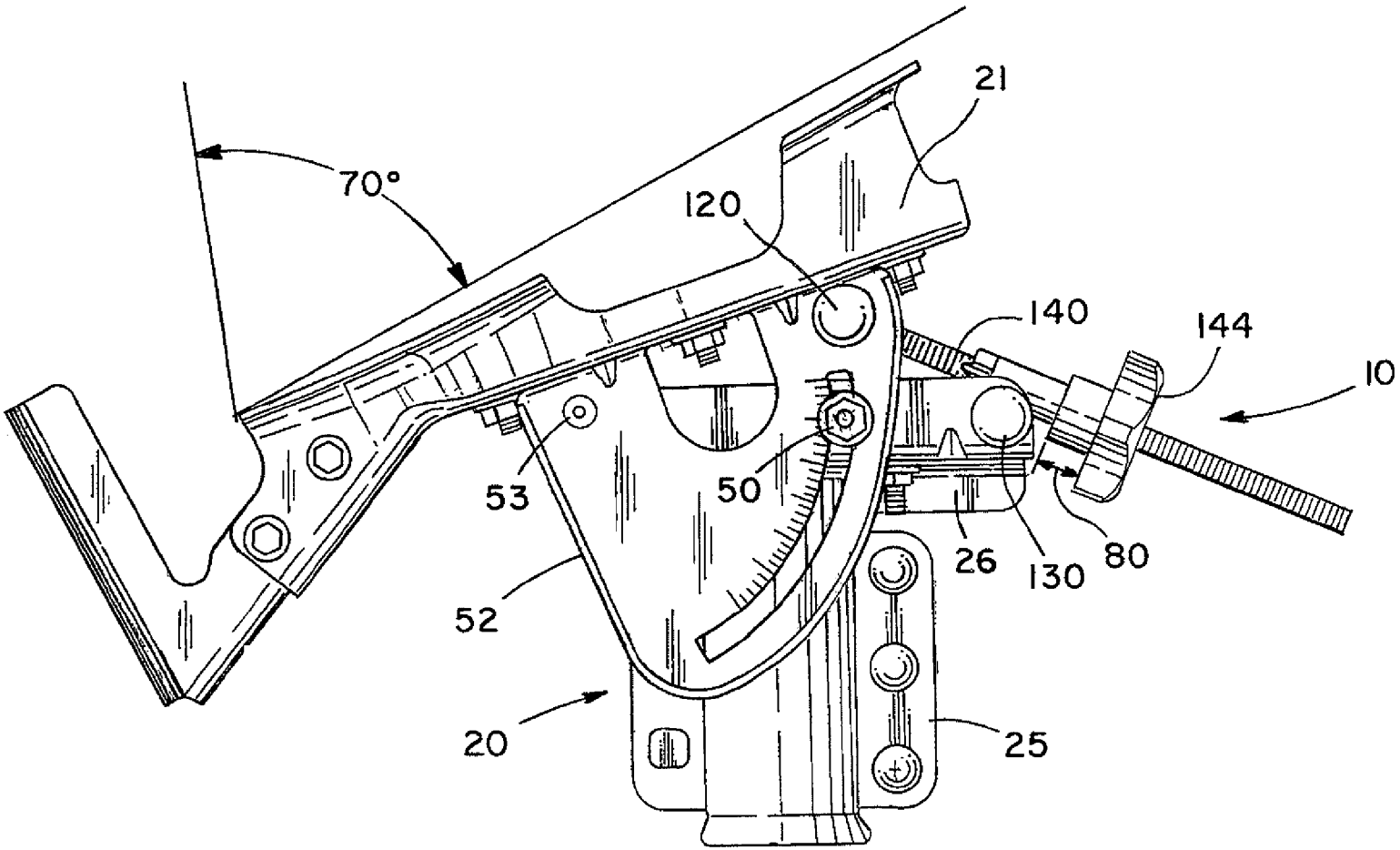
FIG. 5 is a side planar view of FIG. 3 with the fine tune elevator shaft holding the reflector mounting bracket in a 70 degree position.

FIGS. 4 and 5 illustrate the tool 10 providing the mount 20 with a 10 degree position (FIG. 4) and with a 70 degree position (FIG. 5). This illustrates the pivoting of the reflector mounting bracket 21 and elevation bracket 52 with respect to the azimuth base bracket 26 about pivot 53. The drawings in FIGS. 4 and 5 show the mount 20 currently adjustable in elevation from 10 to 70 degrees, but the invention covers any range of adjustment from 0 to 90 degrees. The tool 10 may be designed to work with less than the full range of adjustment as well, based on the system mounting requirements. Any suitable elevation can be obtained by turning the knob 144 between 0 degrees and 90 degrees. The adjustment knob 144 is located a distance 80 from the mount.

Figure 6:
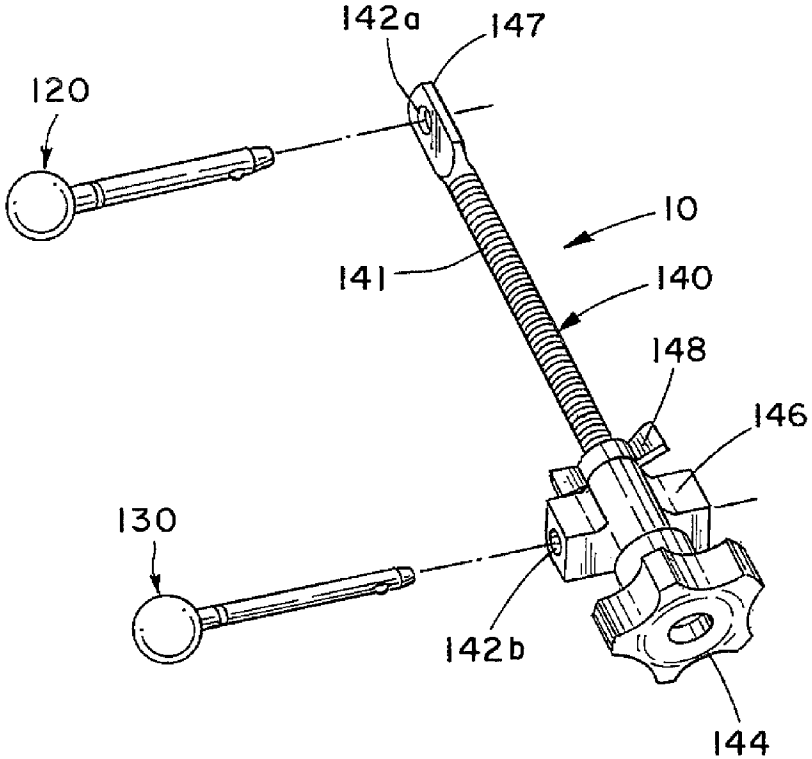
FIG. 6 is an exploded perspective view showing the components of the elevation adjust tool of the invention.

In FIG. 6, the components of the tool 10 are shown to include the two pins 120 and 130 and the elevator shaft 140.

Figure 7:
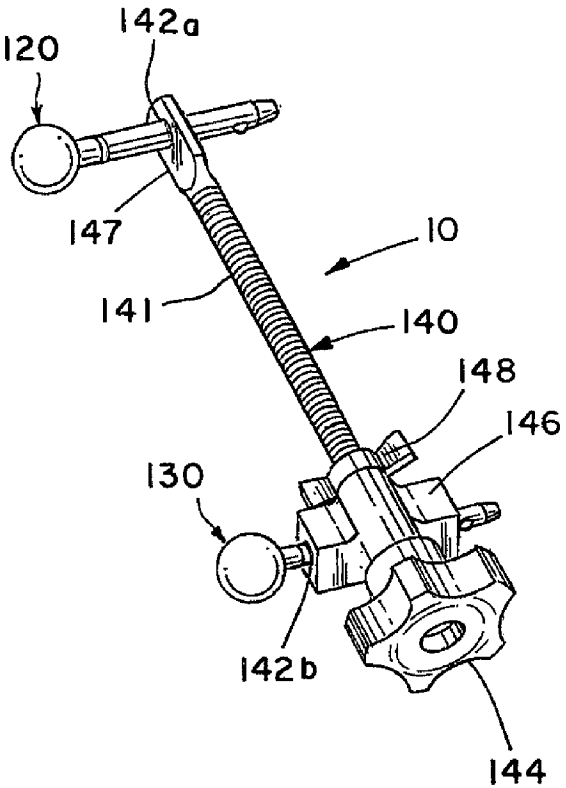
FIG. 7 is a perspective view showing the assembled components of the elevation adjust tool of the invention.

The elongated threaded shaft 140 has threads 141 and a pivot hole 142*a* at one end on a spade shaped flattened head 147 with the elevation adjustment knob 144 at the other end. A wing nut 148 is on the threads 141. Also over threads 141 is a pivot member 146 with a pivot hole 142*b* there through. FIG. 7 shows pins 120, 130 engaging holes 142*a* and 142*b*.

Figure 8:
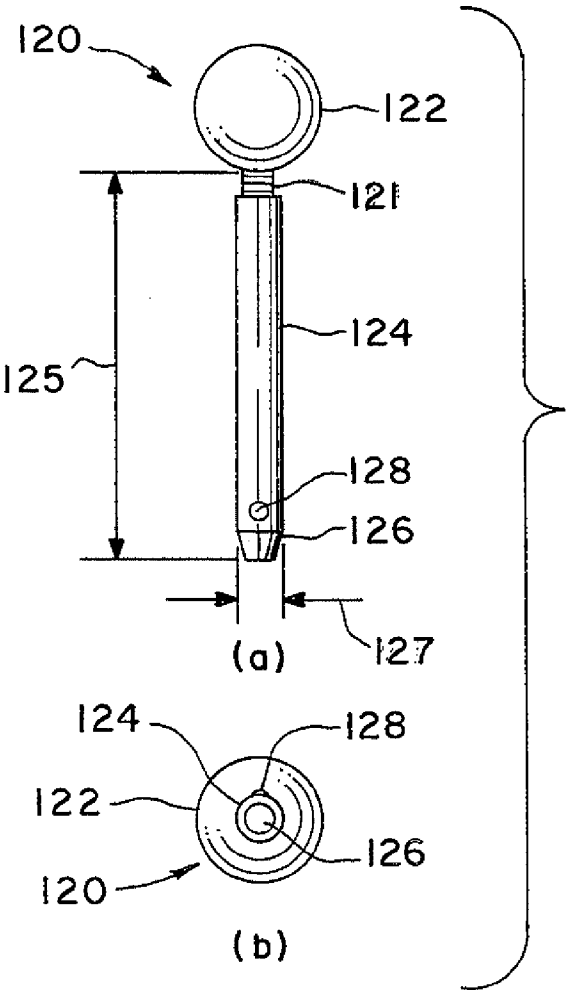
FIGS. 8(*a*) and 8(*b*) set forth the side and top views of the large diameter pin that slides into the upper holes of FIG. 2.

FIGS. 8*a* and 8*b* show details of the larger pin 120 which has a plastic knob 122 engaging a threaded shaft 121 at one end of a steel pin 124. The knob 122 has a diameter of about 0.84 inches and the steel pin has a diameter 127 of about 0.25 inches and a length 125 of about 1.81 inches. The end 126 is tapered.

Figure 9:
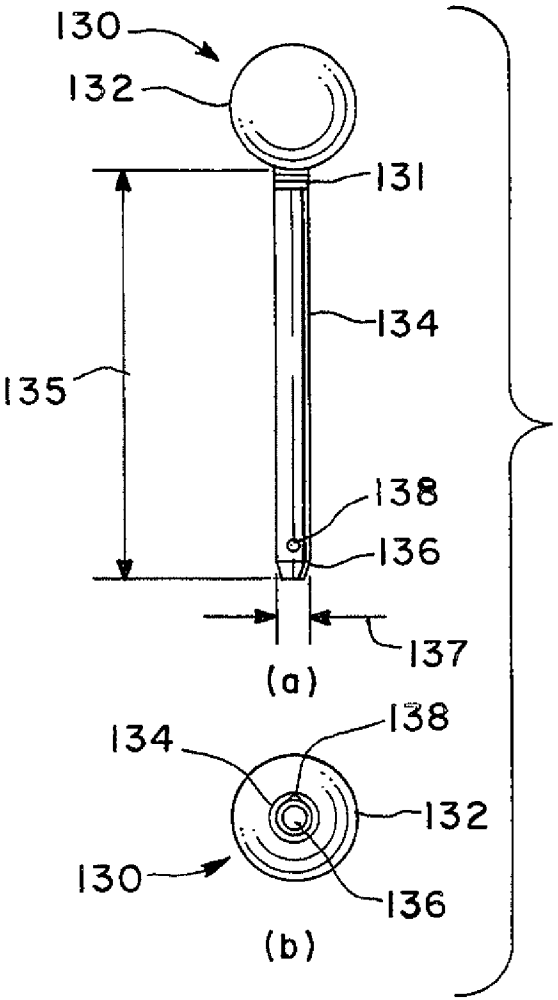
FIGS. 9(*a*) and 9(*b*) set forth the side and top views of the small diameter pin that slides into the lower holes of FIG. 2.

FIGS. 9*a* and 9*b* show details of the smaller pin 130 which has a plastic knob 132 engaging a threaded shaft 131 at one end of a steel pin 134. The knob 132 has a diameter of about 0.84 inches and the steel pin 134 has a diameter 137 of about 0.188 inches and a length 135 of about 1.68 inches. The end 136 is tapered.

In some embodiments, pins 120 and 130 can have the same diameter. In some embodiments, pin 130 can have a larger diameter than pin 120. The lengths 125 and 135 may also be the same or one pin longer or shorter than the other. For mounts 20 designed to be used with the tool 10, the pins 120 and 130 would be the same diameter and the same length.

Optional conventional ball detents 128, 138 could be used at the ends 126, 136 of the pins 120, 130 respectively. These ball detents 128, 138 help keep the pins 120 and 130 from coming out when installed to the brackets 22 and 32. The pins 120, 130 may or may not utilize spring loaded ball retainers or other types of retainers such as cotter pins or clips at the insertion ends, to help keep the pins in place. The pins 120 and 130 could also be bolts with hand tightened nuts. The term "pins" is defined to include all of these configurations, but is not limited thereto.

Any suitable configuration can be utilized for the plastic knobs 122 and 132.

In reference back to FIG. 6, the tool 10 also has an elongated threaded shaft 140, a knob 144, a pivot member 146, and a wing nut 148.

Figure 10:
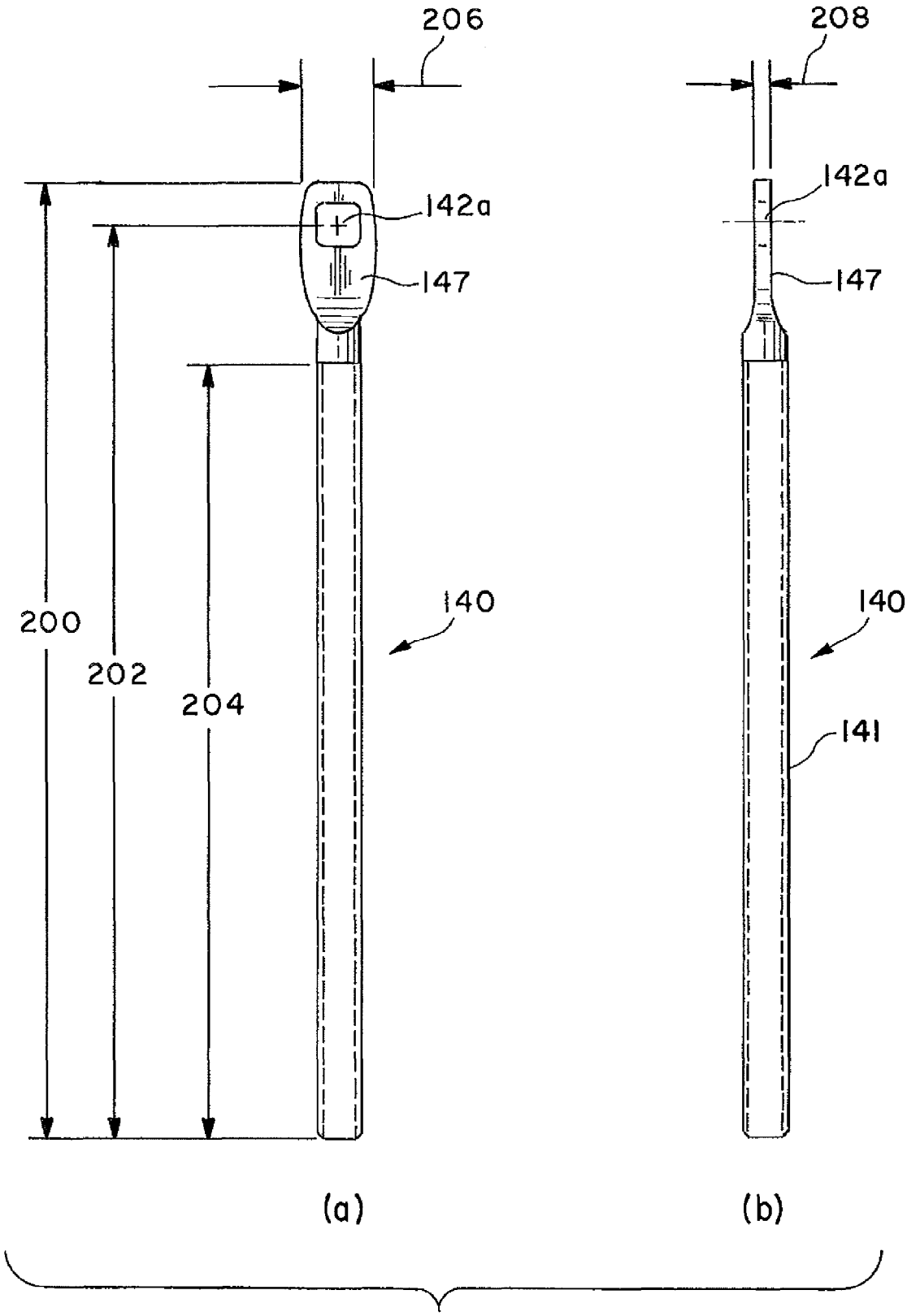
FIGS. 10(*a*) and 10(*b*) sets forth the two side views of the elongated threaded shaft of the removable elevation adjustment tool of FIG. 2.

FIGS. 10(*a*) and 10(*b*) show details of elongated threaded shaft 140 which has a spade shaped flattened head 147 and threads 141. The elongated threaded shaft 140 has the following dimensions: length 200 of about 6.79 inches, length 202 of about 6.5 inches, length 204 of about 5.5 inches, width 206 of about 0.5 inches, and thickness 208 of about 0.12 inches. The elongated threaded shaft 140 threads 141 are 5/16 inch #18 thread. Any suitable thread and dimension can be used for the threaded shaft 140.

Figure 11:
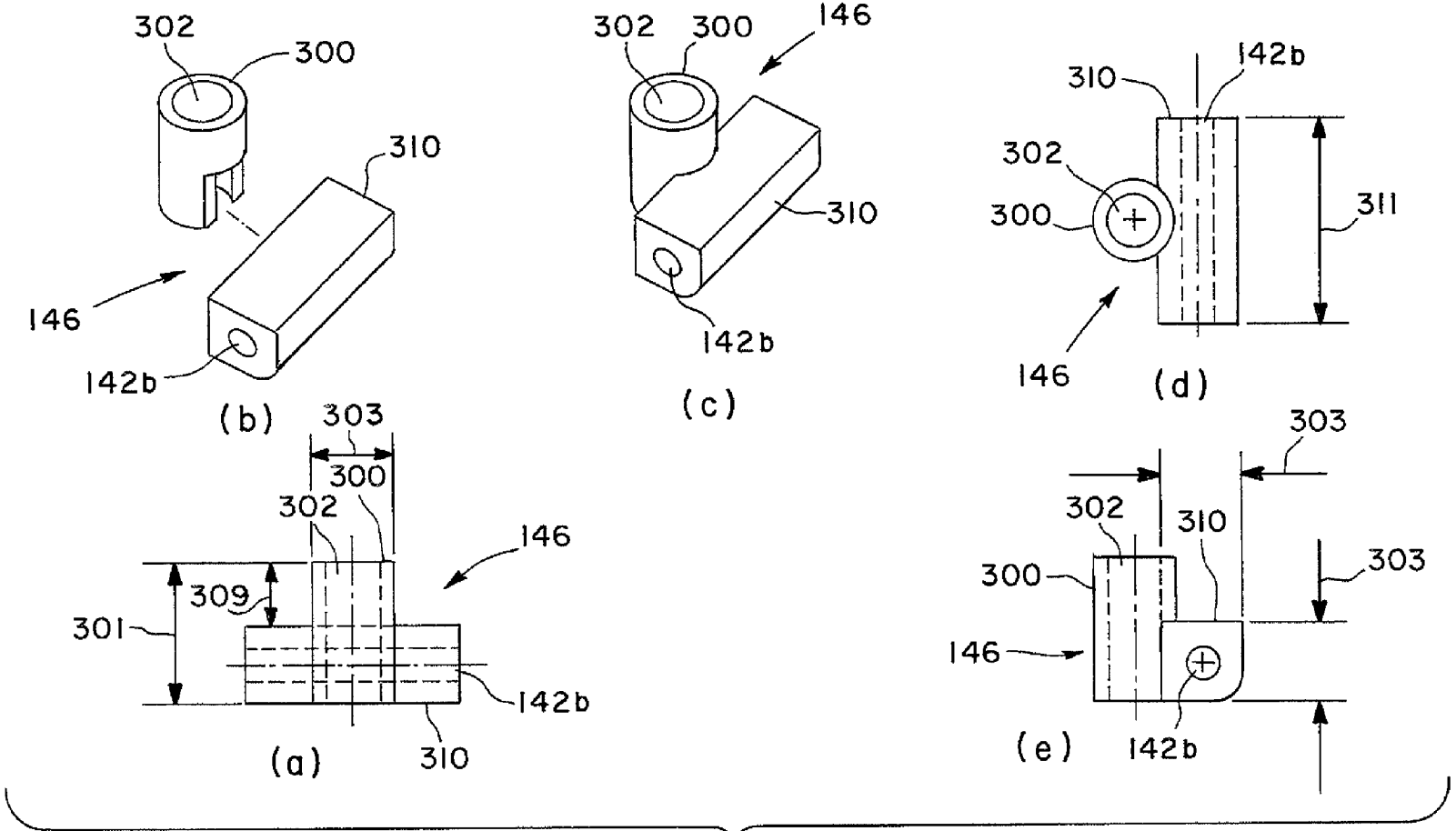
FIGS. 11(*a*) thru 11(*e*) set forth the various views of the pivot member of the removable elevation adjustment tool of FIG. 2.

FIGS. 11(*a*) thru 11(*e*) set forth details of pivot member 146. Pivot member 146 is formed on one piece and includes two portions: a round portion 300 and a square portion 310. These may be cast from aluminum as two pieces that are welded together or as one piece to form an integral pivot member. The pivot member 146 could be stamped or molded from plastic in other embodiments. Round portion 300 has a formed hole 302 with a diameter of about 0.344 inches which slides over the elongated threaded shaft 140 and square portion 310 has a formed hole 142*b* perpendicular to formed hole 302 which receives pin 130.

The round portion 300 is about 0.9 inches in length 301 with an outside diameter 303 of about 0.5 inches. The square portion 310 is perpendicular to the round member 300 and is about 1.3 inches in length 311 and is about 0.5 inches square 303. The formed hole 142*b* has a diameter of about 0.203 inches.

Figure 12:
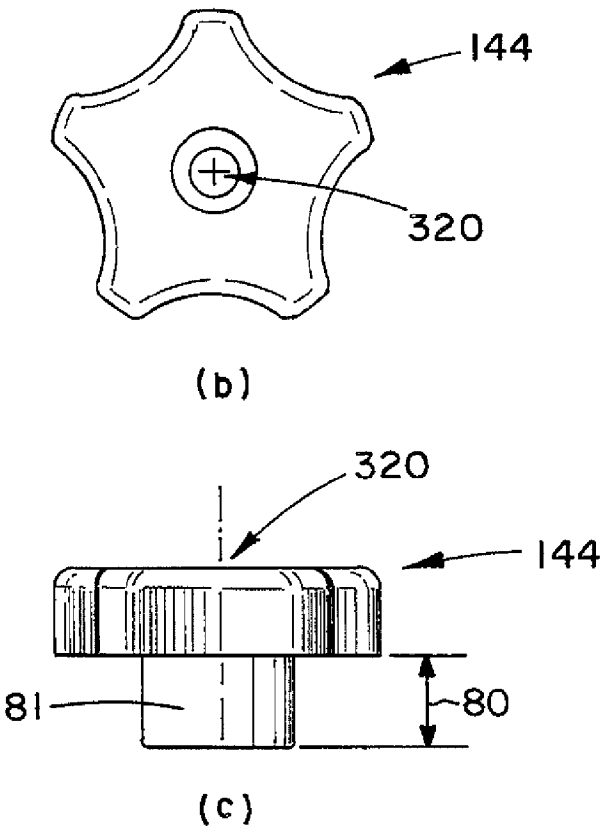
FIGS. 12(*a*) thru 12(*c*) set forth various views of the knob of the removable elevation adjustment tool of FIG. 2.
Figure 12:
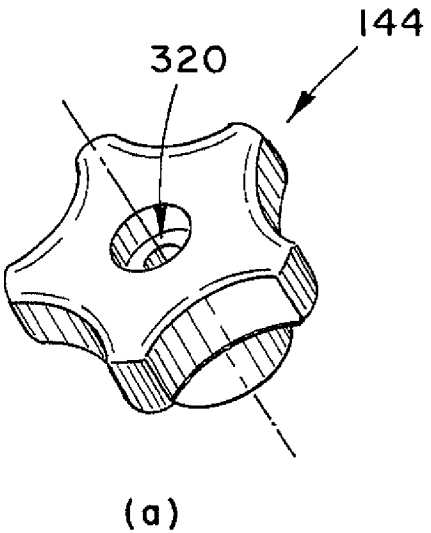

The knob 144 details are shown in FIGS. 12(*a*) thru 12(*c*). The knob 144 has a formed hole 320 which is threaded with 5/16 inch, #18 thread to mate with the threads 141 of threaded shaft 140. Any suitable knob shape or configuration can be used as a turning device on the elongated threaded shaft 140. The tool 10 can also utilize a large knob 132 with a nut molded inside, that can easily be turned by hand to accurately adjust the elevation of the antenna. The knob 144 could also have a nylon insert for a stiffer, anti-spinning action. A larger diameter of the knob 132 results in finer elevation adjustment. As shown in FIGS. 4 and 12(*c*), the knob 144 has a shank 81 with an optional length 80 which is of sufficient length to keep the knob 144 away from the mount 20. This provides clearance for a installers fingers. The shank 81 is optional.

Once the proper elevation is obtained, the wing nut 148 shown in FIGS. 6 and 7 can be hand tightened against the round member 300 to hold the tool 10 in position (especially during windy conditions) The nuts 50 can then be tightened to permanently set the elevation. The wing nut 148 can be any suitable nut, another knob with a threaded nut contained therein, etc. In some embodiments, the wing nut 148 is not used. The threaded shaft 140 can have many different variations other than a spade bolt such as a long threaded standard style bolt. The elongated threaded shaft 140 can include many different adjustment configurations. The elongated threaded shaft 140 is easily removed without the use of hand tools, and independently provides easy adjustment of elevation also without hand tools.

In summary, the tool 10 comprising: an elongated threaded shaft 140 with having a formed hole 142(*a*) at one end; a turning device 144 engaging the threads 141 of the elongated threaded shaft 140 on an opposite end; a pivot member 146 with a first formed hole 302 slideably disposed over the elongated threaded shaft 140, the pivot member 146 having a second formed hole 142(*b*) perpendicular to the first formed hole 142(*a*); a first pin 120 for removably engaging formed hole 142(*a*) and a second pin 130 for removably engaging the second formed hole 142(*b*).

Figure 13:
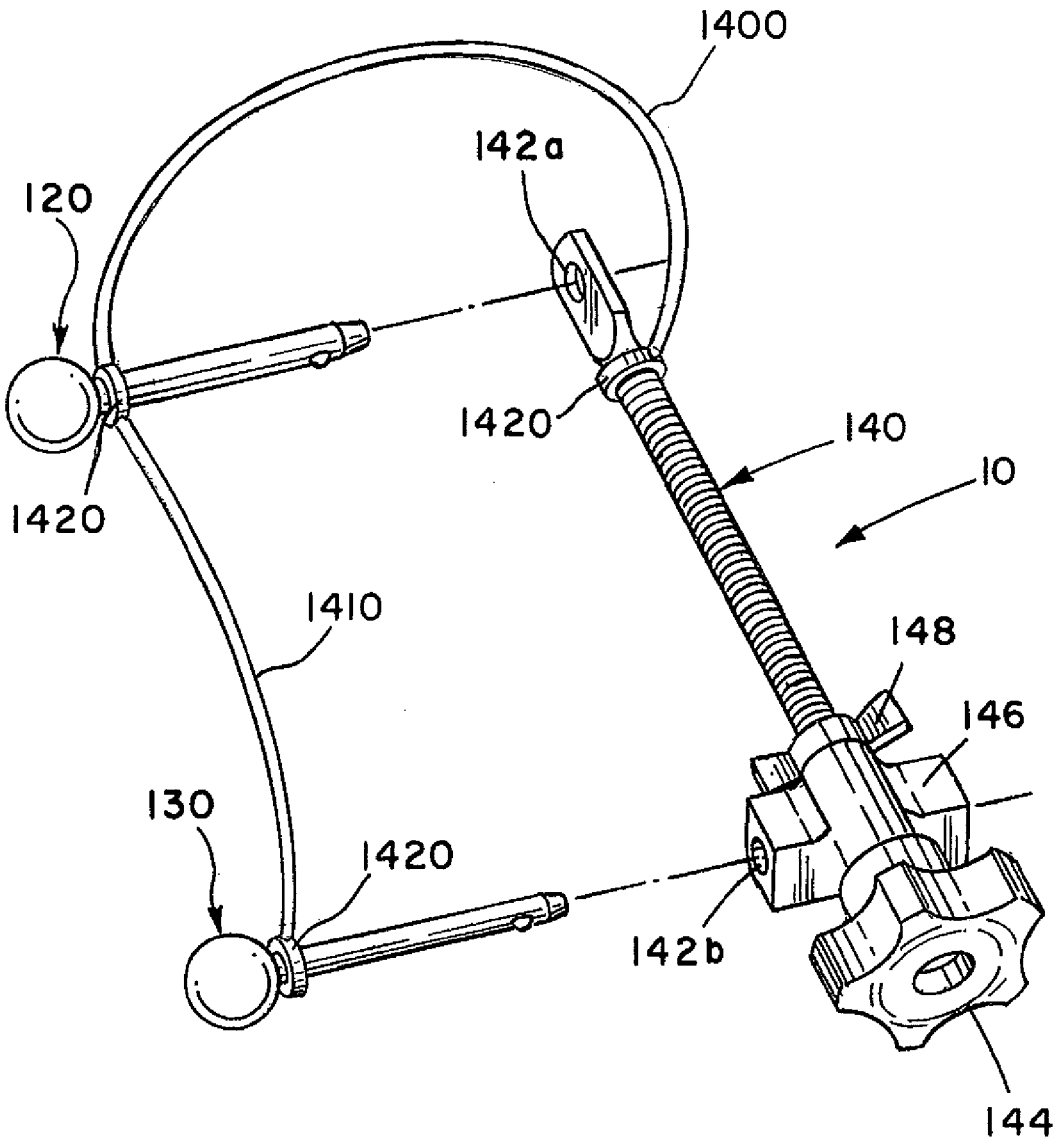
FIG. 13 is a perspective view of the removable elevation adjustment tool of the invention having a tie holding the pins to the elongated threaded shaft.

The tool 10 can optionally have a tie 1400 to hold the pins 120 and 130 to the elongated threaded shaft 140 as shown in FIG. 13. The tie 1400 has a formed circular portions 1420 that firmly engage the pins 120 and 130 around threaded shafts 121 and 131 and elongated threaded shaft 140. When the tool 10 is not in use, the tie 1400 keeps the pins 120, 130 with the elongated threaded shaft 140 so that the installer does not have to search for the pins. The tie 1400 also positions the larger pin 120 and the smaller pin 130 in proper orientation for use so that the installer does not have to determine which is the larger (or smaller) pin. The tie 1400 saves time in the installation process. The tie 1400 (tethered cords or lanyards) could be plastic, braided steel or string. The tie 1400 could be of one-piece construction or made from two pieces.

The tool 10 installs to the mount 20 as shown in FIGS. 2 and 3 without the use of hand tools. Two pins 120 and 130 are inserted on either end of the elongated threaded shaft 140 to brackets 22 and 32. One pin 120 attaches the threaded shaft 140 or rod to the upper elevation bracket 22. The other pin 130 attaches the pivot member 146 secured to the lower bracket 32. These pins 120 and 130 replace conventional pivot joints that are typically made from bolts or rivets, and that are securely fastened and time consuming to remove.

The installer conventionally loosens nuts 50 on the elevation guides 52 as shown in FIG. 3 with a conventional tool. With the tool 10 installed, the antenna 50 can now be easily adjusted in elevation by hand, by turning the adjustment knob 144 to the desired location. The nut 148 is then hand tightened and the nuts 50 are tightened conventionally using the conventional tool (not shown). The fine tune adjustment tool 10 can be easily removed from the satellite antenna mount after use by the installer. All that is required is the removal of the two pins 120 and 130 by simply pulling them out of the brackets 22 and 32 on the mount 20 and out of the elongated threaded shaft 140. The elongated threaded shaft 140 is then removed. No hand tools are required to install, use, and remove the tool 10 of the invention from the mount 20.

The tool 10 can then be taken to a different installation and reused on a different satellite antenna mount 20.

The above disclosure sets forth a basic embodiment of the invention described in detail with respect to the accompanying drawings with a number of variations discussed.

Certain precise dimension values have been utilized in the specification. However, these dimensions do not limit the scope of the claimed invention and that variations in angles, spacings, dimensions, configurations, and dipole shapes can occur.

It is noted that the terms "preferable" and "preferably," are given their common definitions and are not utilized herein to limit the scope of the claimed disclosure. Rather, these terms are intended to highlight alternative or additional features that may or may not be utilized in a particular embodiment of the present disclosure.

For the purposes of describing and defining the present disclosure it is noted that the term "substantially" is given its common definition and it is utilized herein to represent the inherent degree of uncertainty that may be attributed to any shape or other representation.

Those skilled in this art will appreciate that various changes, modifications, use of other materials, other structural arrangements, and other embodiments could be practiced under the teachings of the invention without departing from the scope of this invention as set forth in the following claims.

I claim:

1. A removable fine tune elevation tool for use on a satellite antenna mount, said mount pivoting between a pair of upper elevation brackets and a pair of lower elevation brackets, said removable fine tune elevation tool comprising:

a threaded shaft having a formed hole at one end, a knob, said knob having a formed threaded hole engaging said threaded shaft opposite said one end;

a pivot member having a first portion and a second portion, said second portion oriented perpendicular to said first portion, said first portion having a formed hole disposed over threads of said threaded shaft between said one end and said knob, said second portion having a formed pivot hole;

an upper pin engaging said formed hole at said one end of said threaded shaft and formed holes in said upper pair of elevation brackets to hold said one end of said threaded shaft in said pair of upper elevation brackets when said removable fine tune elevation tool is used;

a lower pin engaging said formed pivot hole of said second portion of said pivot member and said formed holes in said lower pair of elevation brackets to hold said second portion in said pair of lower elevation brackets when said removable fine tune elevation tool is used wherein said upper and lower pins each further comprise a detent ball at one end;

wherein when said knob is turned said threaded shaft moves through said formed threaded hole of said knob against said pivot member to slide said formed hole in said first portion of said pivot member over the threaded shaft to pivot said upper pair of elevation brackets with respect to said lower pair of elevation brackets.

2. A removable fine tune elevation tool for use on a satellite antenna mount, said mount pivoting between a pair of upper elevation brackets and a pair of lower elevation brackets, said removable fine tune elevation tool comprising:

a threaded shaft having a formed hole at one end, a knob, said knob having a formed threaded hole engaging said threaded shaft opposite said one end;

a pivot member having a first portion and a second portion, said second portion oriented perpendicular to said first portion, said first portion having a formed hole disposed over threads of said threaded shaft between said one end and said knob, said second portion having a formed pivot hole;

an upper pin engaging said formed hole at said one end of said threaded shaft and formed holes in said upper pair of elevation brackets to hold said one end of said threaded shaft in said pair of upper elevation brackets when said removable fine tune elevation tool is used;

a lower pin engaging said formed pivot hole of said second portion of said pivot member and said formed holes in said lower pair of elevation brackets to hold said second portion in said pair of lower elevation brackets when said removable fine tune elevation tool is used;

a flexible tie connected to said lower pin at one end of said flexible tie, to said one end of said threaded shaft at the opposite end of said flexible tie, and to said upper pin between said ends of said flexible tie for holding said upper and lower pins to said threaded shaft;

wherein when said knob is turned said threaded shaft moves through said formed threaded hole of said knob against said pivot member to slide said formed hole in said first portion of said pivot member over the threaded shaft to pivot said upper pair of elevation brackets with respect to said lower pair of elevation brackets.

3. A removable fine tune satellite elevation tool comprising:

an elongated threaded shaft having a formed hole at one end;

a turning device engaging the threads of said elongated threaded shaft opposite said one end;

a pivot member, said pivot member having a first formed hole slideably disposed over the threads of said elongated threaded shaft, said pivot member having a second formed hole perpendicular to said first formed hole;

a first pin for removably engaging said formed hole at said one end of said threaded shaft;

a second pin for removably engaging said second formed hole in said pivot member wherein said first and second pins each further comprise a detent ball at one end.

4. The removable fine tune satellite elevation tool of claim 3 wherein said pivot member comprises:

a first cast portion having said first formed hole;

a second cast portion having said second formed hole, said first cast portion welded perpendicularly to said second cast portion.

5. The removable fine tune satellite elevation tool of claim 3 wherein said pivot member is formed as one piece.

6. The removable fine tune satellite elevation tool of claim 3. wherein said turning device is a knob.

7. The removable fine tune satellite elevation tool of claim 3 wherein said first and second pins each further comprise:

a pin shaft;

a knob affixed at one end of said pin shaft.

8. The removable fine tune satellite elevation tool of claim 3 wherein said first and second pins are of different diameters relative to each other.

9. The removable fine tune satellite elevation tool of claim 3 wherein said first and second pins are of different lengths.

10. The removable fine tune satellite elevation tool of claim 3 wherein at least one of said first and second pins is unthreaded and has a substantially smooth, tapering end.

11. The removable fine tune satellite elevation tool of claim 10 wherein both of said first and second pins are unthreaded and have substantially smooth, tapering ends.

12. A removable fine tune satellite elevation tool comprising:

an elongated threaded shaft having a formed hole at one end;

a turning device engaging the threads of said elongated threaded shaft opposite said one end;

a pivot member, said pivot member having a first formed hole slideably disposed over the threads of said elongated threaded shaft, said pivot member having a second formed hole perpendicular to said first formed hole;

a first pin for removably engaging said formed hole at said one end of said threaded shaft;

a second pin for removably engaging said second formed hole in said pivot member; and a flexible tie connected to said first pin at one end of said flexible tie, to said one end of said elongated threaded shaft, and to said second pin.

13. The removable fine tune satellite elevation tool of claim 12 with at least one of said first and second pins being unthreaded and having a substantially smooth, tapering end.

14. The removable fine tune satellite elevation tool of claim 13 wherein both of said first and second pins are unthreaded and have substantially smooth, tapering ends.

15. The removable fine tune satellite elevation tool of claim 12 wherein said first and second pins each further comprise:

a pin shaft;

a knob affixed at one end of said pin shaft.

16. The removable fine tune satellite elevation tool of claim 12 wherein said first and second pins are of different diameters relative to each other.

17. The removable fine tune satellite elevation tool of claim 12 wherein said first and second pins are of different lengths.

18. A removable fine tune satellite elevation tool comprising:

an elongated threaded shaft having a formed hole at one end;

a knob engaging the threads of said elongated threaded shaft opposite said one end;

a pivot member, said pivot member having a first formed hole slideably disposed over the threads of said elongated threaded shaft, said pivot member having a second formed hole perpendicular to said first formed hole;

a first pin for removably engaging said formed hole at said one end of said threaded shaft;

a knob on one end of said first pin;

a second pin for removably engaging said second formed hole in said pivot member;

a knob on one end of said second pin;

a flexible tie connected to said first pin, to said second pin, and to the said elongated threaded shaft.

19. The removable fine tune elevation tool of claim 18 wherein said first and second pins have respective shafts and wherein said respective shafts are of different diameters relative to each other.

20. The removable fine tune elevation tool of claim 18 wherein said first and second pins are of different lengths.

* * * * *